United States Patent [19]

Sheppard

[11] 4,415,162

[45] Nov. 15, 1983

[54] DART TARGET SYSTEM

[76] Inventor: David P. Sheppard, 7928 State St., Ralston, Nebr. 68127

[21] Appl. No.: 287,362

[22] Filed: Jul. 27, 1981

[51] Int. Cl.[3] ..... F41J 3/00; F41J 3/02

[52] U.S. Cl. ..... 273/371; 273/386; 273/408

[58] Field of Search ..... 273/368, 371, 386, 408

[56] References Cited

U.S. PATENT DOCUMENTS

| | | | |
|---|---|---|---|
| 1,076,002 | 10/1913 | Clarke | 273/408 |
| 3,756,599 | 9/1973 | Imatt et al. | 273/408 |
| 3,836,148 | 9/1974 | Manning | 273/371 X |
| 3,899,170 | 8/1975 | Parks et al. | 273/127 D |
| 3,941,379 | 3/1976 | Paule et al. | 273/44 |
| 4,322,073 | 3/1982 | Slavik et al. | 273/1 GC |

*Primary Examiner*—Anton O. Oechsle
*Attorney, Agent, or Firm*—Hiram A. Sturges

[57] ABSTRACT

A dart target system comprising a first target movably mounted on a frame for rotation about a first axis, whereby when a greater number of darts are stuck in the target on one side of the axis than the other, then that one side will be below the other side, indicating victory for the player throwing toward the one side. An electrical system forming a part of the dart target system and delivering a light or other sensible signal of one nature when the victory is achieved by a person throwing on one side of the target and of a different nature when a victory is achieved by a person throwing at the opposite side of the target.

6 Claims, 10 Drawing Figures

DART TARGET SYSTEM

BACKGROUND OF THE INVENTION

It is a major object of this invention to provide a dart board which will become illuminated in accordance with the accuracy of the thrown darts.

An objective is to provide a rotating part of the dart board which rotates in one direction in accordance with one or more accurately thrown darts by a first player striking the rotating portion in a position that the weight of the dart causes the rotating portion to move downwardly; thereafter, one or more accurately thrown darts by a second player into an opposite part of the rotating portion will cause the rotating portion to rotate in an opposite direction and to assume a position reflecting success by the second player, provided his dart or darts are far enough from the center of rotation and sufficient in number to more than counter-balance darts thrown into the rotating portion by the first player.

Another object is to provide a lighting system for the dart board so designed that lights of one color will illuminate in a rewarding and indicative fashion when one player is ahead and so that lights of a different color will go on, replacing the first lights, when a second player is ahead.

A further object is to provide for the lights being of the flashing kind so as to give the board a maximum of action.

Other objectives are to provide a dart board on which a variety of games can be played and enjoyed.

Still another object is to provide a dart board concept, rotating portions of which can be varied in number and position, all within the concepts of the invention.

SUMMARY OF THE INVENTION

The major goal of this invention is to provide a dart target system comprising a first target movably mounted on a frame for rotation about a first axis, whereby when a greater number of darts are stuck in the target on one side of the axis than the other, then that one side will be below the other side, indicating victory for the player throwing toward the one side.

DESCRIPTION OF THE PREFERRED EMBODIMENT

Figure 1:
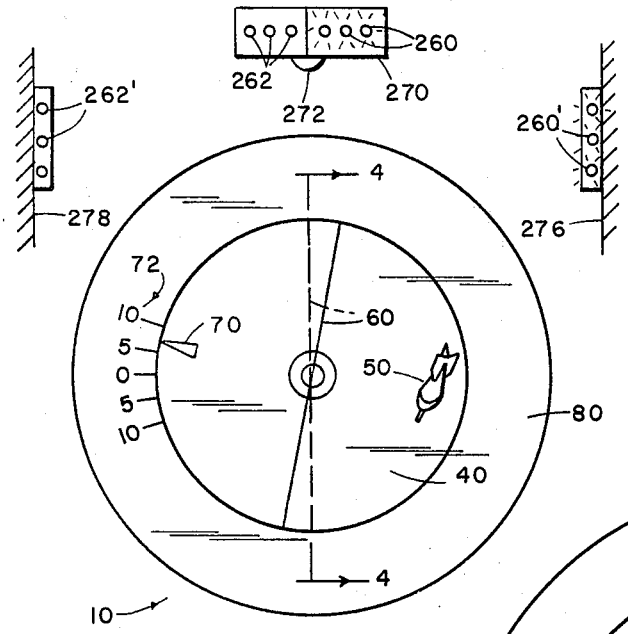
FIG. 1 is a frontal elevation of the dart board of this invention showing associated lights but not showing their connection to the dart board, a dotted line indicating a starting position of a target and full lines indicating the position of parts after one dart has been accurately thrown.
Figure 2:
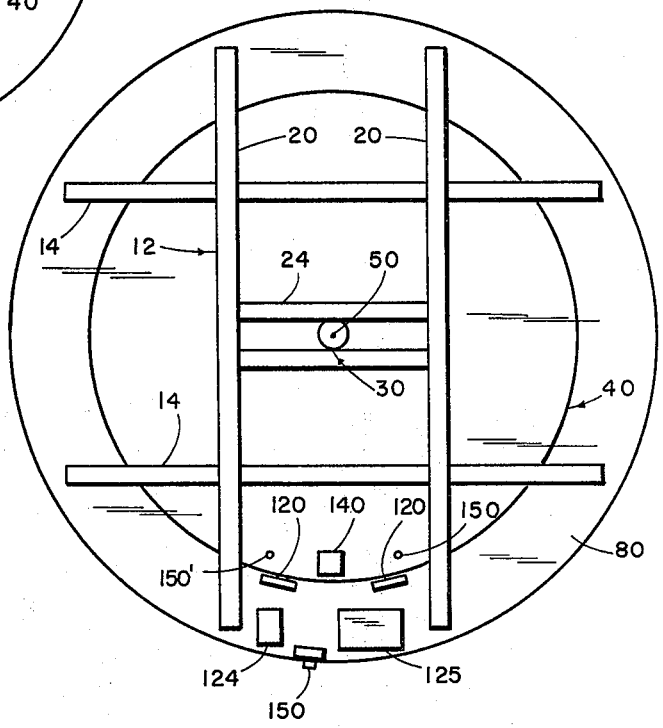
FIG. 2 is a rear view of the dart target system of FIG. 1 with the exception that it does not show the lights above the board and also it shows the target in a starting or neutral position.

Referring to FIG. 1, the dart target system of this invention is generally indicated at 10 and it comprises a frame 12, seen only in FIG. 2, comprising a pair of vertically spaced horizontal members 14 fixed to a pair of horizontally spaced vertical members 20.

Two central horizontal frame members 24 are disposed one on each side of a hub generally indicated at 30 which is fixed to the horizontal members 24. The hub 30 is surrounded by a bearing assembly 36, which latter is attached to a first target carrier 38, which latter supports the first target 40 which is preferably in the shape of a circular disc, as best seen in FIG. 1, having a forward target surface 42 shown in FIG. 4, which latter is vertical and at a right angle to an axis of rotation 50, seen in FIG. 2.

The surface 42 is formed of a material suitable for the penetration thereof by pointed ends of darts such as the dart 50 of FIG. 1 so as to support and retain darts stuck therein in the usual manner. Since the target 40 is free to rotate about the axis 50, then any excess of darts stuck into the target 40 on the right side of a center line 60 will tend to cause the target 40 to be weighted downwardly on its right side so that the center line 60, which is normally vertical, as shown in dotted lines in FIG. 1, will have moved to the full-line position in FIG. 1, whereby the victory by the player who has the most strategically placed darts on the right side of the board, will be indicated by an arrow 70 shown on the forward side of the target 40 as read against a scale shown at 72 in FIG. 1, so as to indicate a score achieved by the player throwing at the right side of the board.

Conversely, if the player throwing at the left side of the board should have superior dart positions in number or in distance from the axis 50, then the arrow 70 would be disposed beneath a zero score point and in an area on the scale 72 showing the score achieved by the player throwing at the left side of the board.

Darts that miss the target 40 tend to be received in an annular backing portion 80 which surrounds the target 40 and is fixed to the frame members 14 and 20 in a suitable manner. Darts can stick in the portion 80 also.

Figure 4:
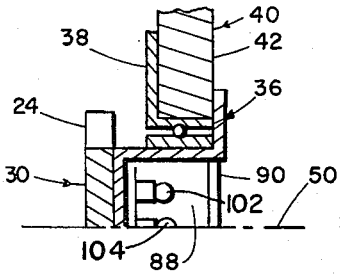
FIG. 4 is a vertical section taken through a central part of the target system of FIG. 1 showing the hub and bearing arrangement, a portion thereof below the axis of rotation not being shown because it is a duplicate of portions thereabove.
Figure 7:
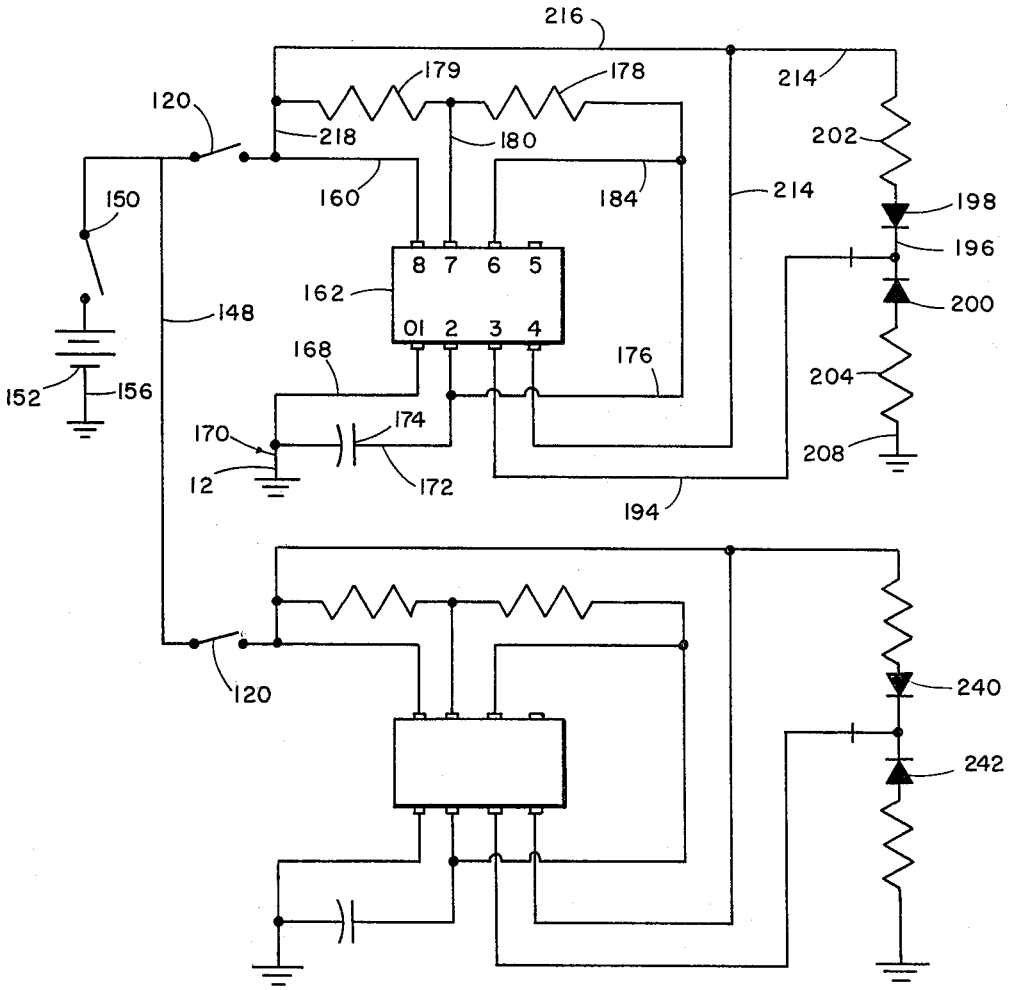
FIG. 7 is a wiring diagram of the dart target system of FIG. 1.

Referring now to FIG. 4, the hub 30 will be seen to be hollow, providing a cavity 88 protected by transparent cover 90 and in which there are preferably four bulbs, including two green bulbs 102 disposed above one another, and two yellow bulbs 104 disposed alongside each other. See FIG. 1A. It is desired that the bulbs 102 be illuminated when the target 40 is in the position shown in FIG. 1. For that purpose, an electrical circuit diagram is provided, as seen in FIG. 7.

Referring now to FIG. 2, a pair of SPST magnetic reed switches are shown at 120 and are spaced around the periphery of the circular target 40.

The switches 120 are operated by the proximity of a magnetically attractable element 140 which is preferably of iron and which is attached to the rearward side of the target 40 in a position normally exactly between the two switches 120 at times when the target 40 is at rest with its center line 60 vertical, as seen in FIG. 1, at which position the arrow 70 would be on zero in the scale 72 and no lights would be lit.

As best seen in FIG. 2, a pair of limit members 150 are fixed to the backside of the target 40 in positions for bumping into the right and left frame members 20 as the target 40 rotates so as to limit rotation thereof in each direction.

As best seen in FIG. 7, the two switches 120 are connected by a wire 148 to a switch 150, seen also in FIG. 2, which latter can be hand-operated to turn the system on. The switch 150 is itself connected to a power source 152 grounded at 156 to the frame 12.

The other terminal of one of the switches 120 is connected by a wire 160 to a timer 162 which can be called I.C.1 timer which is a 555 timer having four terminals bearing indicia 1–8 respectively.

The terminal 1 is connected by a wire 168 to ground at 170 which is the frame 12. A terminal 2 is connected by a wire 172 to a capacitor 174 which is identified as C-12.2uF.

The terminal 2 is also connected by a wire 176 to a resistor 178 which has its other terminal in series with a resistor 179 and a wire 180 extends from between the resistors 178 and 179 down to terminal 7.

A wire 184 connects the wire 176 to terminal 6.

The terminal 3 is connected by a wire 194 to a point midway on a wire 196 between two lights 198 and 200 which are specifically preferably green lights and are each of the LED type. The other terminals of each light 198 and 200 are connected to resistors 202 and 204 respectively, and the resistor 204 is connected to the frame ground 208. The other terminal of the resistor 202 is connected by a wire 214 to the terminal 4 and a wire 216 connects the wire 214 to the other terminal of the resistor 179 and the latter terminal is itself also connected by a wire 218 to the wire 160.

The resistors at 178 and 179 are specifically 100 Kn and 10 Kn, respectively.

The other switch 120 is connected to a pair of yellow lights 240 and 242 and also to the ground at the frame with an identical circuit to that connecting the switch 120 to its lights 198 and 200. For that reason, detailed discussion of the bottom half of the circuit of FIG. 7 would not be necessary.

Figure 1A:
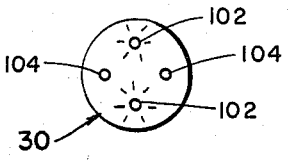
FIG. 1A is a detail of a modified hub with lights on it as seen in frontal elevation.

The green lights 198 and 200 in circuit of FIG. 7 are representative of the green bulbs or lights 102 of FIG. 1A and illumination is at the hub, as is one modification seen in FIGS. 1A and 4. Likewise lights 240 and 242 of FIGS. 7 are yellow lights representative of the yellow lights or bulbs of FIG. 1A and FIG. 4 modification.

In operation, the circuit of FIG. 7 will cause the two green lights 102 to alternatively be illuminated in rapid succession whenever the target 40 is in the position shown in FIG. 1 so that the corresponding one of the switches 120 is closed by the presence of the iron member 140 in its vicinity.

Conversely, the two yellow lights 104 will be caused to alternately be illuminated whenever the iron element 140 is in the vicinity of the other of the switches 120.

Referring to FIG. 1, a set of forward lights are shown at 260 and these are green and are wired into the circuit exactly the same as the LED 198 so as to blink on and off. The green lights 260, therefore, are on and off at exactly the same time that the other green lights are on and off at 102.

A second set of lights 262 are yellow and are wired into the circuit the same as the light LED 240 so as to go on and off. Therefore, the yellow lights 262 of FIG. 1 go on and off at exactly the same times that the yellow lights 104 go on and off, since these are all representative of the diagram of FIG. 7.

The lights 260 and 262 can be mounted on a member 270, which latter is fixed to a wall surface portion which is seen at 272 and which latter is the same wall on which the frame 12 can be supported for upholding the target system 10.

Alternately, green light bulbs 260' can be mounted on a side wall of a dart booth, such side wall being seen at 276, and yellow lights can be mounted on an opposite side wall 278 as seen at 262'. The lights 260' and 262' can be wired into the circuit in exactly the same way as the lights 260 and 262.

Figure 3:
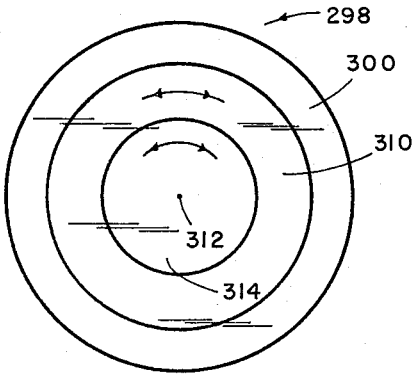
FIG. 3 diagrammatically illustrates a modification of the invention in which, in addition to a first circular central dart target, there is also an annular or O-shaped target surrounding the first target and providing a second target.

We refer now to FIG. 3 in which a second modified target system is shown having an annular O-shaped backing 300 surrounding a annular shaped or circular shaped target 310, which latter rotates about an axis 312, the axis 312 being at the center of a central rotating target 314, also rotating about the axis 312.

Figure 6:
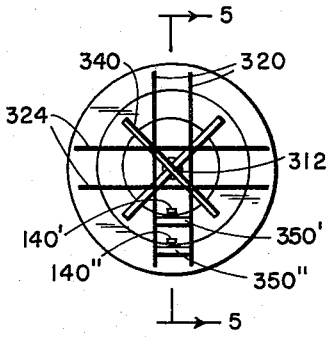
FIG. 6 is a rear view of the dart target system of the modified type of FIG. 3. The electrical system components of the FIG. 6 modification are not shown, except as in each of two boxes, with the exception of the iron switch actuators for each of the targets of FIG. 6, which latter are shown outside the boxes.

The backside of the target system 298 of FIG. 3 can be seen in FIG. 6 and it comprises two horizontally spaced vertical members 320 on opposite sides of the axis 312 and two vertically spaced horizontally extending members 324 on opposite sides of the axis 312, the members 320 and 324 being attached to the outer O-shaped backing 300.

The target 310 which can be called and O-shaped second target is supported on its own criss-cross frame 340, which latter has its own hub 342 mounted on an axle 346 on the axis 312, the axle 346 being the same axle that supports a hub 30' similar to the hub 30 of the FIG. 4 modification, whereby a first or central circular disc-shaped target 314 is supported on a hub 30' and by similar means as is the first target 40 in FIG. 1.

Figure 5:
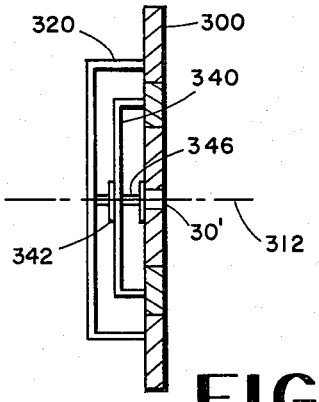
FIG. 5 is a left-hand elevation of parts shown in FIG. 6.

Light signal systems similar to FIG. 1 can be used with the modification of FIGS. 3 and 5 and, for that purpose, magnetically attractable members 140' and 140'' are mounted on the rearward side of the targets 314 and 310 for the same purpose as the magnetizable member 140 of FIG. 2. Circuitry operated by the magnetizable members 140' and 140'' is not shown, but it can be considered to be disposed in boxes 350' and 350'', seen in FIG. 6 and attached to the frame members 320.

Figure 8:
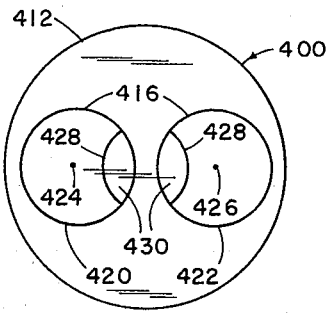
FIG. 8 is a third modification of the dart target system in which two rotating targets are disposed alongside each other inside a circular backing.

A third modification of the dart board is seen in FIG. 8 in which a dart target system is shown generally at 400 having an outer backing portion 412 with two circular openings 416 therethrough in which a first target 420 and a second target 422 are mounted so as to be disposed alongside each other and to rotate about axis 424 and 426 horizontally spaced from each other. The axes 424 and 426 are horizontal and marking 428 on the targets 420 and 422 can indicate the areas 430 which are preferred target areas.

Figure 9:
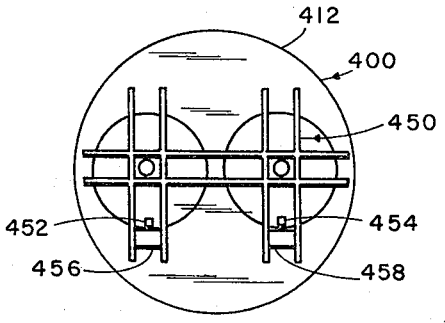
FIG. 9 is rear view of the modification of FIG. 8 with all parts of the electrical system shown in two boxes with the exception of two magnetic switch actuating members.

A frame 450 is provided on the backside of the target system 400 of FIG. 8, as best seen in FIG. 9, and the same principles apply as described in FIG. 2, each target 420 and 422 having its separate lighting system as symbolized by separate magnetically attractable members 452 and 454 which can also be called switch actuators 452 and 454, for operating with electrical systems disposed in boxes 456 and 458 respectively.

In FIG. 1 a battery holder is shown at 124 and a circuit box at 125 is mounted on the backside of the backing portion 80 as are also the switches 120 and 150. Limit members 150' protrude from the backside of the first target 40, as seen in FIG. 2, in positions for striking frame members 20 respectively so as to limit clockwise and counterclockwise movements of the target 40 to an amount of movement equivalent to an acute angle of about 10° clockwise or counter-clockwise.

I claim:

1. A target system comprising a a frame, first target module movably mounted on said frame for rotation about a first substantially horizontal axis, said first target module having a target module surface disposed transversely to said axis, said surface being suitable for penetration by pointed ends of darts sufficient to support and retain darts stuck therein whereby a dart stuck in said first target module on one side of a vertical plane extending through said axis tends to cause said first target module to rotate about said first axis downwardly on the side of said vertical plane in which said dart is stuck, a dart with a pointed end, said pointed end being stuck in said target module surface, a victory indication means correlated with said first target module and said frame, whereby at a given time the position of said first target module with respect to said frame can be sensed by the players, said victory indication means comprising an electrical signal system having a sensible signal.

said signal being activated responsive to the position of a magnetically attractable member with respect to a magnetically operated switch, the magnetically attractable member and the magnetically operated switch being permanently mounted during use of said system one on said target module and one on a portion of said system which is fixed to said frame.

2. The dart target system of claim 1 in which said victory indication means comprises blinking electrical light sources.

3. The dart target system of claim 1 in which a backing is attached to said frame and surrounds said first target module, said backing being adapted to be penetrated by the pointed end of a dart so as to permit a dart to be stuck therein.

4. The dart target system of claim 3 in which a second target module is movably mounted alongside said first target module as said system is seen from its forward side.

5. The dart target system of claim 3 in which a a second target module is movably mounted alongside of said first target module and within said backing as said system is seen from its forward side.

6. The dart target system of claim 3 having said backing and said first target module each provided with a substantially vertically forward surface, said forward surfaces being in substantially the same plane.

* * * * *